US009580894B2

(12) United States Patent
Paar

(10) Patent No.: US 9,580,894 B2
(45) Date of Patent: Feb. 28, 2017

(54) URINAL CLOG REMOVAL DEVICE

(71) Applicant: Michael J. Paar, Mesa, AZ (US)

(72) Inventor: Michael J. Paar, Mesa, AZ (US)

( * ) Notice: Subject to any disclaimer, the term of this patent is extended or adjusted under 35 U.S.C. 154(b) by 119 days.

(21) Appl. No.: 14/688,482

(22) Filed: Apr. 16, 2015

(65) Prior Publication Data

US 2016/0305104 A1 Oct. 20, 2016

(51) Int. Cl.
*E03C 1/306* (2006.01)
*E03D 13/00* (2006.01)

(52) U.S. Cl.
CPC ..... *E03C 1/306* (2013.01); *E03D 13/005* (2013.01)

(58) Field of Classification Search
CPC ..... E03C 1/306; E03D 13/005
USPC ..... 4/252.2, 252.4, 255.06
See application file for complete search history.

(56) References Cited

U.S. PATENT DOCUMENTS

2015/0026874 A1* 1/2015 Bogard ..... E03D 13/005 4/301

* cited by examiner

*Primary Examiner* — Tuan N Nguyen
(74) *Attorney, Agent, or Firm* — Schmeiser, Olsen & Watts LLP

(57) ABSTRACT

A urinal clog removal device is provided. The urinal clog removal device may include a urinal flange connecting member formed of a body. The urinal flange connecting member may include slots on opposing sides configured to couple to the urinal flange connecting member to a urinal flange. The urinal flange connecting member comprises an aperture extending through the urinal flange connecting member to provide access to the urinal flange. The device may also include a hose coupled on a first end to the urinal flange connecting member with a hose connector. The hose connector of the urinal flange connecting member directs water into the urinal flange. The device may also include a valve and is coupled to a flush valve of the urinal, wherein the hose is coupled between the valve and the hose connector in order to supply water through the hose and into the urinal flange during unclogging.

20 Claims, 3 Drawing Sheets

URINAL CLOG REMOVAL DEVICE

BACKGROUND OF THE INVENTION

Technical Field

This invention relates generally to plumbing clog removal device and more particularly to a urinal clog removal device.

State of the Art

Toilets and urinals are common plumbing fixtures for removal of human waste. These plumbing fixtures are susceptible to clogs that inhibit proper function of fixture. Toilets can often be unclogged using a plunger or a plumbing cable without the removal of the toilet. Urinals, however, require the removal of the urinal from the wall to provide access to the urinal flange and allow the use of a plumbing cable to remove the clog.

When using the plumbing cable, it is often desirable to use a hose to direct water into the urinal flange and send the clog through the pipes. Further, the water may be used to clean the plumbing cable during use. The plumber must then operate the plumbing cable with one hand while holding the hose with the other hand. This causes difficulty in operating the plumbing cable. Additionally, the hose must be connected to a water source that is not in the bathroom because the bathroom water must be turned off in order to remove the urinal.

Accordingly, there is a need in the field of plumbing clog removal devices for an improved urinal clog removal device.

SUMMARY OF THE INVENTION

The present invention relates to a urinal clog removal device, wherein the device couples to a urinal flange and further couples to a hose to direct water into the urinal flange. Further, the device includes an aperture for extending a plumbing cable there through and into the urinal flange.

An embodiment may include a urinal clog removal device comprising a urinal flange connecting member configured to couple to a urinal flange, the urinal flange connecting member comprising an aperture extending through the urinal flange member to provide access to the urinal flange; and a hose coupled on a first end to the urinal flange connecting member, wherein the urinal flange connecting member comprises a hose connector to direct water into the urinal flange.

Another embodiment may include a urinal clog removal device comprising a urinal flange connecting member formed of a body comprises slots on opposing sides, the urinal flange connecting member configured to couple to a urinal flange by use of connectors engaging the slots, wherein the urinal flange connecting member comprises an aperture extending through the urinal flange member to provide access to the urinal flange; and a hose coupled on a first end to a hose connector of the urinal flange connecting member, wherein the hose connector directs water into the urinal flange.

Another embodiment may include a method of removing a clog in a urinal, the method comprising removably coupling a urinal clog removal device to a urinal flange; coupling a hose to the urinal clog removal device; extending a plumbing cable through the urinal clog removal device to unclog the urinal; and directing water through the hose and into the urinal flange to direct material unclogged through the pipes.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a urinal clog removal device, wherein the device couples to a urinal flange and further couples to a hose to direct water into the urinal flange. Further, the device includes an aperture for extending a plumbing cable there through and into the urinal flange.

Embodiments of the present invention have been provided to allow a plumber to unclog a urinal more easily. The urinal clog removal device allows a plumber to use both hands to operate the plumbing cable to break up the clog and further to have direct control over the flow of water into the urinal flange.

Figure 1:
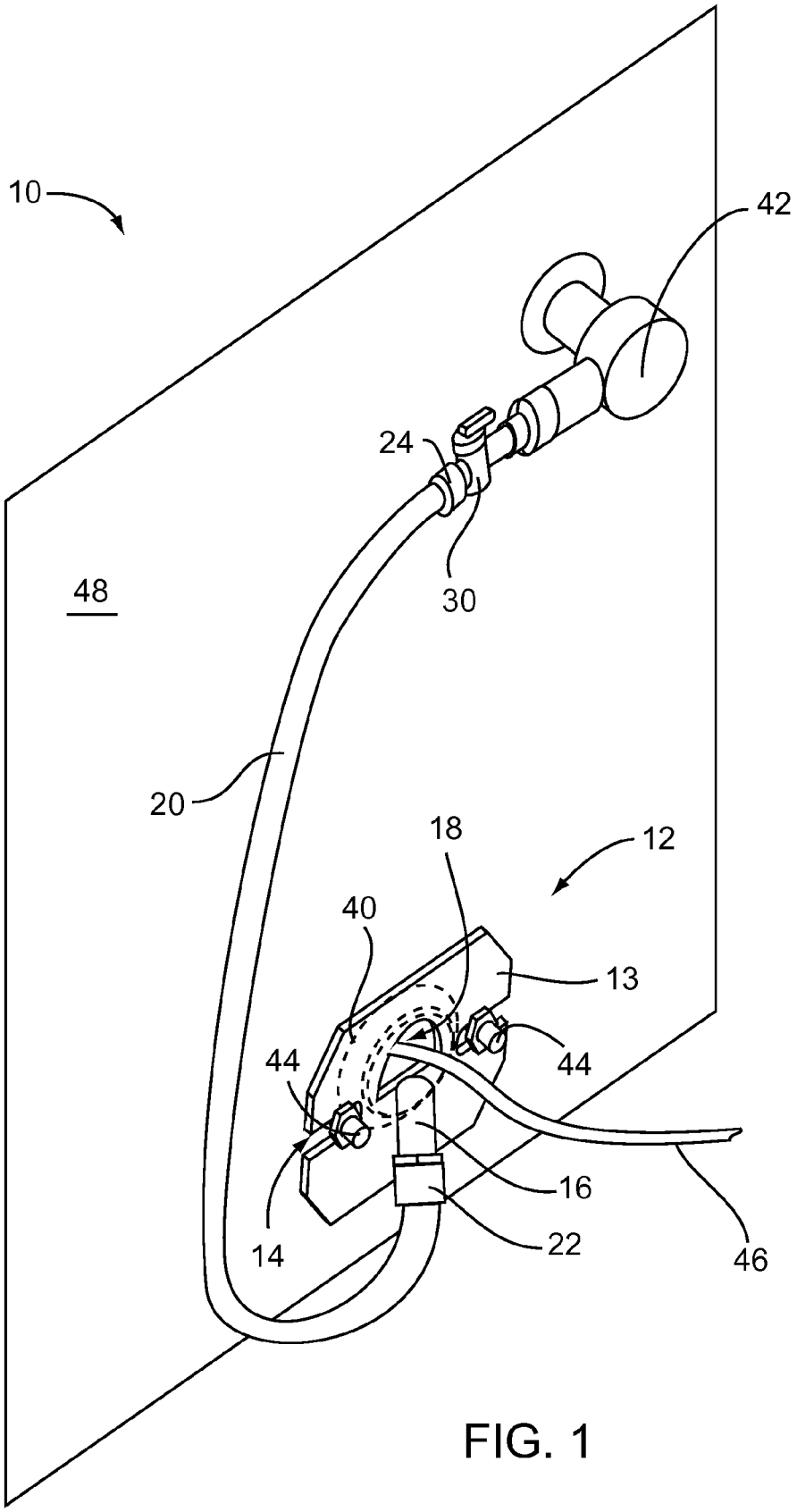
FIG. 1 is a perspective view of a urinal clog removal device.

Referring to the drawings, FIG. 1 depicts a perspective view of an embodiment of a urinal clog removal. The urinal clog removal device 10 comprises a urinal flange connecting member 12, a hose 20 and a valve 30.

Figure 2:
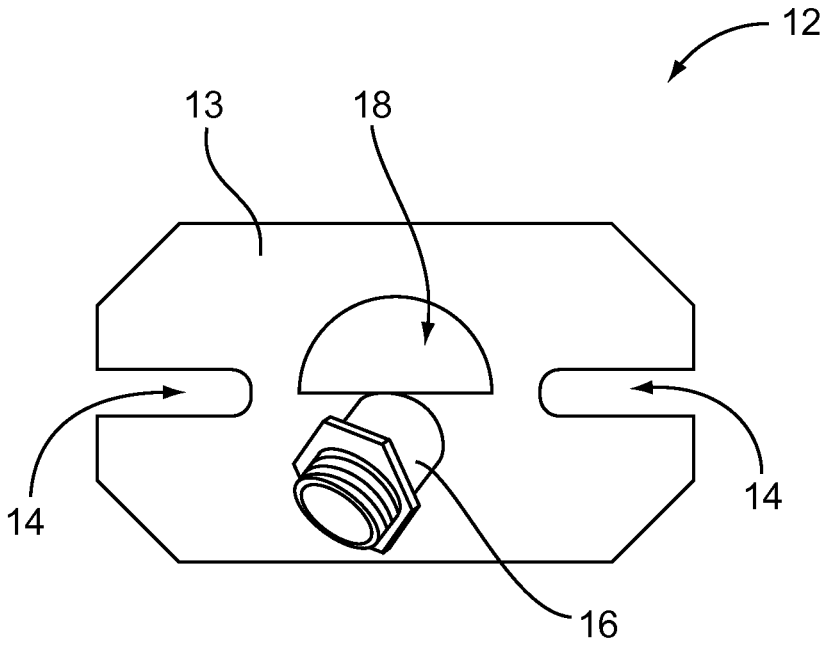
FIG. 2 is a front view of a urinal flange connecting member of a urinal clog removal device.
Figure 3:
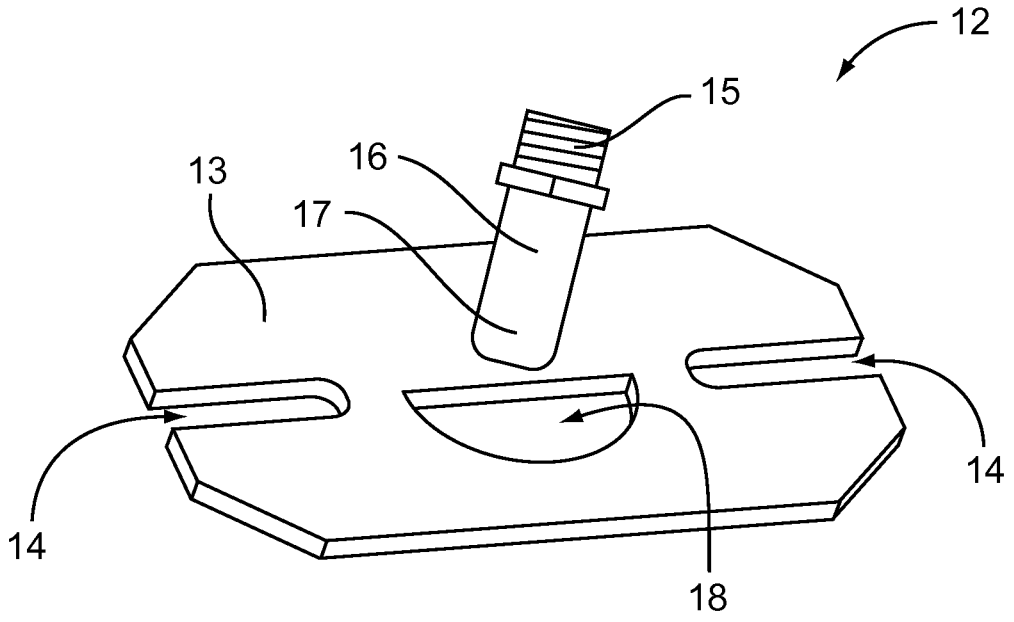
FIG. 3 is a perspective view of a urinal flange connecting member of a urinal clog removal device.
Figure 4:
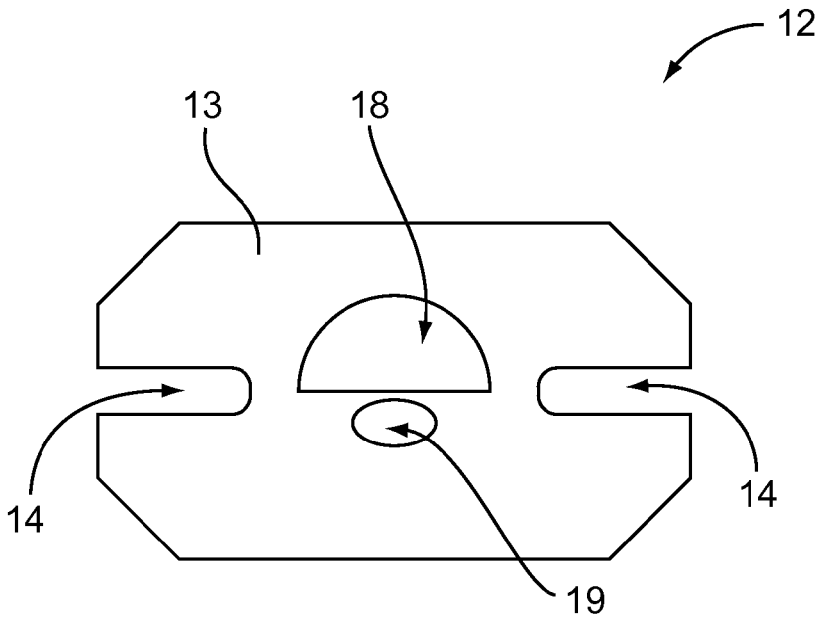
FIG. 4 is a rear view of a urinal flange connecting member of a urinal clog removal device.

With further reference to FIGS. 2-4, the urinal flange connecting member 12 may include a body 13, slots 14 formed on opposing sides of the body 13, a hose connector 16 and an aperture 18. The slots 14, while shown as slots extending through the end of the body 13, may also comprise slotted apertures or circular apertures extending through the body 13. The slots 14 allow for mounting rods 44 of a urinal flange 40 mounted to the wall 48 to extend to a front side of the body 13. Then connectors, such as nuts may be coupled to the mounting rods 44 in order to removably couple to the urinal flange connecting member 12 to the urinal flange 40. Coupling the urinal flange connecting member 12 to urinal flange 40 creates a seal between the body 13 and a gasket of the urinal flange 40. This seal prevent water from flowing onto the ground and making a mess of the work area.

The aperture 18 extends through the body 13 and is of sufficient size to allow a plumbing cable 46 to extend through the body 13 and into the urinal flange 40. The aperture 18 aligns with the opening of the urinal flange 40 when the urinal flange connecting member 12 is coupled to the urinal flange 40. A plumber can utilize two hands to operate the plumbing cable to extend and operate the plumbing cable 46 within the urinal flange 40 and pipes connected thereto within the wall 48.

The hose connector 16 comprises a first end 15 configured to couple to a first end 22 of the hose 20. The hose connector 16 may be coupled to the body 13 adjacent the aperture 18. The hose connector provides fluid communication from the front of the body 13 to the back of the body 13 through opening 19. Accordingly, water running through the hose 20 when coupled to the hose connector 16 will flow through the hose connector 19 and out of opening 14. When the urinal flange connecting member 12 is coupled to the urinal flange 40, the opening 19 in the body 13 is aligned with the opening of the urinal flange 40 to allow for water flowing through opening 19 to be directed into the urinal flange 40. As shown in the drawings, the hose connector 16 is angled in its connection to the body 13. This angle allows the plumber to connect the hose in a location so as to not to interfere with the aperture 18 and inhibit use of the plumbing cable 46. While the hose connector 16 is shown at an angle, it will be understood that the hose connector 16 can be located at any angel with respect to the urinal flange connecting member 12 without deviating from the intended use of the present invention. Additionally, the hose connector 16 may be any type of hose connector so long as the hose connector directs water into the urinal flange 40.

The valve 30 may be coupled to a urinal flush valve 42 extending from a wall 48. The valve 30 may have a control knob 32 to control on and off of the water flow as well as how fast the water flows. A second end 24 of the hose 20 may be coupled to the valve 30. In at least this way, the plumber may use the water source within the bathroom to direct water into the urinal flange 40. The valve 30 allows for the plumber to start, stop and control speed of water flow into the urinal flange 40. The device 10 as a whole allows for directing water into the urinal flange 40 without the use of a handle of the plumber, thereby allowing the plumber to utilize both hands to operate the plumbing cable 46. Additionally, the use of the valve 30 eliminates the need to run a long hose to an external water supply by allowing the plumber to use the water supply right above the urinal flange 40.

It will be understood that while certain shapes of components are shown, the present invention is not limited to the shapes shown and described. Any shape of component is acceptable so long as it performs the intended function.

Figure 5:
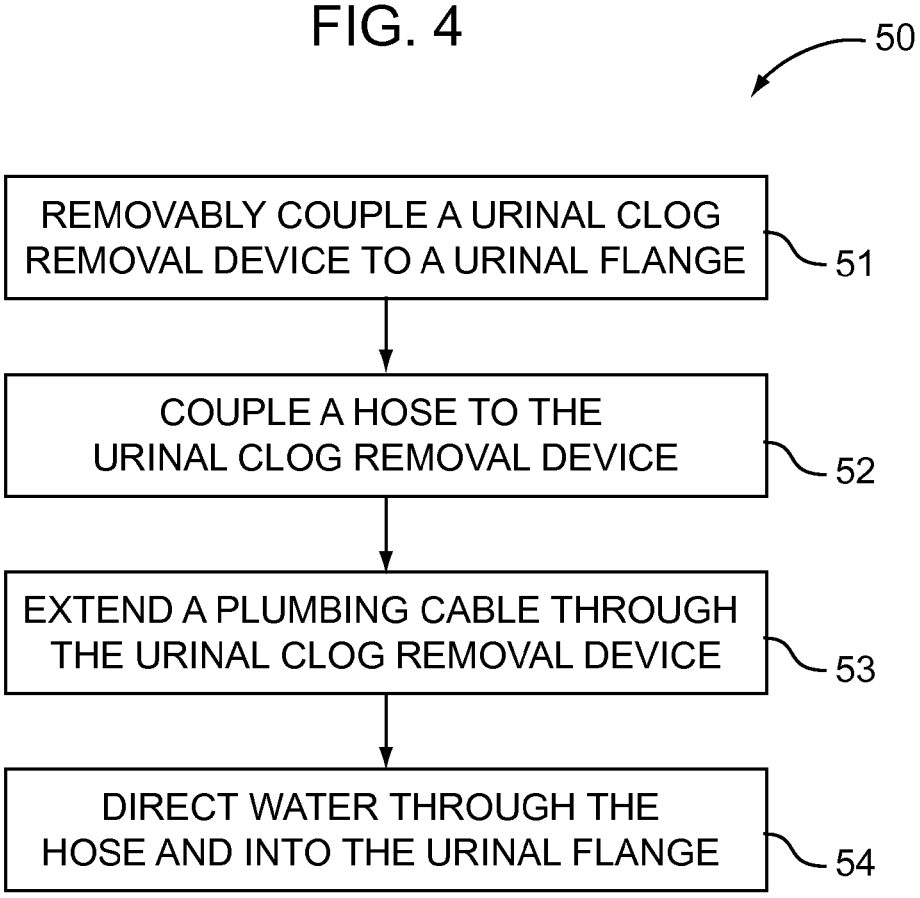
FIG. 5 is a flow chart of a method of unclogging a urinal in accordance with embodiments of the present invention.

Referring again to the drawings, FIG. 5 depicts a flow chart showing a method 50 of unclogging a urinal. The method 50 may include removably coupling a urinal clog removal device to a urinal flange (Step 51); coupling a hose to the urinal clog removal device (Step 52); extending a plumbing cable through the urinal clog removal device to unclog the urinal (Step 53); and directing water through the hose and into the urinal flange to direct material unclogged through the pipes (Step 54).

The method 50 may include additional steps. Step 52 of coupling the hose to the urinal clog removal device comprises coupling the hose to a hose connector of the urinal clog removal device.

Method 50 may also comprise connecting a valve of the urinal clog removal device to a flush valve of the urinal; and coupling the hose to the valve of the urinal clog removal device. The method 50 may also comprise controlling water directed into the urinal flange by use of the valve.

Method 50 may also include a step of removing a urinal from the urinal flange prior to removably coupling the urinal clog removal device to the urinal flange. Additionally, Step 54 of directing water through the hose into the urinal flange may further comprise cleaning the plumbing cable with the water. For example, the method 50 may include directing water from the hose connector to the plumbing cable while pulling the plumbing cable out the urinal drain and urinal flange. This allows the plumbing cable to be cleaned from any urine buildup transferred to the plumbing cable during the unclogging process and keeps the plumbing cable from obtaining foul odors.

The components defining any urinal clog removal device may be formed of any of many different types of materials or combinations thereof that can readily be formed into shaped objects provided that the components selected are consistent with the intended operation of a urinal clog removal device. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any urinal clog removal device may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A urinal clog removal device comprising:

a urinal flange connecting member configured to couple to a urinal flange, the urinal flange connecting member comprising:

an aperture extending through the urinal flange connecting member to provide access to the urinal flange; and a hose connector configured to couple to a hose to direct water into the urinal flange.

2. The device of claim 1, wherein the urinal flange connecting member comprises a body.

3. The device of claim 2, wherein the body of the urinal flange connecting member comprises slots on opposing sides.

4. The device of claim 3, wherein the urinal flange connecting member is coupled to the urinal flange by use of connectors engaging the slots.

5. The device of claim 1, wherein the hose connector comprises a first end configured to couple to a hose and a second end coupled to the urinal flange connecting member.

6. The device of claim 1, further comprising a valve.

7. The device of claim 5, wherein the valve is coupled to a flush valve of a urinal.

8. The device of claim 6, wherein the hose is coupled on a second end to the valve.

9. A urinal clog removal device comprising:

a urinal flange connecting member comprising:

a body having slots on opposing sides, wherein the urinal flange connecting member is configured to couple to a urinal flange by use of connectors engaging the slots;

an aperture extending through the urinal flange connecting member to provide access to the urinal flange; and a hose connector; and a hose coupled on a first end to the hose connector of the urinal flange connecting member, wherein the hose connector directs water into the urinal flange.

10. The device of claim 9, wherein the hose connector comprises a first end configured to couple to a hose and a second end coupled to the urinal flange connecting member.

11. The device of claim 9, further comprising a valve.

12. The device of claim 11, wherein the valve is coupled to a flush valve of a urinal.

13. The device of claim 12, wherein the hose is coupled on a second end to the valve.

14. A method of removing a clog in a urinal, the method comprising:

removably coupling a urinal clog removal device to a urinal flange;

coupling a hose to the urinal clog removal device;

extending a plumbing cable through the urinal clog removal device to unclog the urinal; and directing water through the hose and into the urinal flange to direct material unclogged through the pipes.

15. The method of claim 14, wherein coupling the hose to the urinal clog removal device comprises coupling the hose to a hose connector of the urinal clog removal device.

16. The method of claim 14, further comprising connecting a valve of the urinal clog removal device to a flush valve of the urinal.

17. The method of claim 16, further comprising coupling the hose to the valve of the urinal clog removal device.

18. The method of claim 17, further comprising controlling water directed into the urinal flange by use of the valve.

19. The method of claim 14, further comprising removing a urinal from the urinal flange prior to removably coupling the urinal clog removal device to the urinal flange.

20. The method of claim 14, wherein directing water through the hose into the urinal flange further comprises cleaning the plumbing cable with the water.

* * * * *